US005347669A

United States Patent [19]

Neviaser et al.

[11] Patent Number: 5,347,669

[45] Date of Patent: Sep. 20, 1994

[54] INFANT SLEEPING POSITION RESTRAINT

[76] Inventors: Thomas J. Neviaser; Lynn W. Neviaser, both of 10135 Wendover Dr., Vienna, Va. 22181; Moira A. Bennett, 46546 Woodhaven Ct., Sterling, Va. 20165

[21] Appl. No.: 999,370

[22] Filed: Dec. 31, 1992

[51] Int. Cl.[5] ..... A47C 20/02

[52] U.S. Cl. ..... 5/655; 5/657; 5/630

[58] Field of Search ..... 5/655, 657, 652, 632, 5/630, 465, 922

[56] References Cited

U.S. PATENT DOCUMENTS

| | | | |
|---|---|---|---|
| 786,722 | 4/1905 | Breslin et al. . | |
| 794,160 | 7/1905 | Breslin et al. . | |
| 2,404,505 | 7/1946 | Knecht | 5/655 |
| 2,724,133 | 11/1955 | Sorrell . | |
| 3,485,241 | 12/1969 | Polley . | |
| 3,721,434 | 3/1973 | Spies | 5/655 |
| 3,924,282 | 12/1975 | Bond | 5/632 |
| 4,383,713 | 5/1983 | Roston | 5/655 |
| 4,441,221 | 4/1984 | Enste | 5/655 |
| 4,571,757 | 2/1986 | Zolecki | 5/922 |
| 4,733,836 | 3/1988 | Barnes | 5/655 |
| 5,048,542 | 9/1991 | Murray . | |
| 5,165,130 | 11/1992 | Wendling | 5/657 |
| 5,193,238 | 3/1993 | Clute | 5/655 |

FOREIGN PATENT DOCUMENTS

| | | | |
|---|---|---|---|
| 162244 | 5/1948 | Austria . | |
| 2249975 | 10/1972 | Fed. Rep. of Germany . | |
| 1449012 | 7/1965 | France | 5/655 |

*Primary Examiner*—Flemming Saether

*Attorney, Agent, or Firm*—Fay, Sharpe, Beall, Fagan, Minnich & McKee

[57] ABSTRACT

An infant is positioned on its side between two pads to restrain its movement during rest time or sleeping. A strap passed around the infant and under the arms maintains the infant's position with respect to the pads. In one embodiment, a diaper-like holding device is secured to the infant and the pads attached thereto. In another embodiment, the pads are positioned on a support member and the infant is positioned on its side between the pads.

3 Claims, 3 Drawing Sheets

INFANT SLEEPING POSITION RESTRAINT

BACKGROUND OF THE INVENTION

In the United States, it has been considered advisable to position infants, herein referring to as newborn babies up to the age of one year, so that they will sleep on their stomachs, a prone position, to keep the infants from choking if they burp or spit-up while sleeping. The American Academy of Pediatrics has recently recommended to doctors that infants sleep supine, that is on their sides or backs, because of a link between an increased risk of Sudden Infant Death Syndrome (SIDS) and the prone position. SIDS is a mysterious affliction that strikes infants without warning and the infants suddenly stop breathing for reasons that is still not understood and that don't show up on autopsies. In a period of 1980 to 1987 in the United States, there was a male death rate of 0.16% from SIDS, with a female death rate somewhat less. While the syndrome can occur anytime during the first year of life, about 90% of the cases cluster in babies 2 to 6 months of age. SIDS strikes about 1 in every 1,000 infants in the United States and kills an estimated 6,000 babies yearly.

SUMMARY OF THE INVENTION

It is an object of the present invention to restrain an infant, a human baby less than one year old, during sleeping so that they will sleep on their side and generally be prevented from sleeping on their back or stomach. The infant is prevented from sleeping on his back to prevent or reduce problems that may occur, such as choking, if the infant burps or spits-up while sleeping. On the side, it is easier for the infant to clear spit-up or burped material from his air passages than if he were on his back. Also, there is evidence to indicate that there is a link between babies sleeping on their stomachs and SIDS, and studies have indicated that changing sleeping patterns from stomach to the side have substantially reduced the occurrence of SIDS.

According to one embodiment of the present invention, pads are attached to the front of the infant to effectively prevent the infant from rolling on to their stomach during sleeping. A similar pad is secured to the back of the infant, to effectively prevent the infant from rolling onto their back during sleeping. Of course, these pads respectively prevent an infant from being placed on their stomach or placed upon their back. The pads can be identical to reduce manufacturing costs and to prevent problems of choosing which pad to place in which position, although the pads can be different. Further, the pads are preferably wider at their base where they contact the infant to resist shifting, twisting and general misalignment of the pad than they are at their apex, which is the surface furthermost from the infant. This reduction from base to apex permits the infant to rock back and forth, that is towards their back and towards their front to provide for some movement and exercise during sleeping and when awake, which is beneficial. The holding device for attaching the pad is provided with a crotch strap, which will ensure that the pads can only be placed on the front and back, and not on the sides of the infant. Further, the crotch strap will prevent the pads from rising-up to interfere with the infants face.

In the first embodiment, each of the pads is secured to the holding device by means of Velcro to permit easy attachment and removal of the pads for adjustment, cleaning and replacing. The holding device comprises a plurality of straps generally in the shape of a diaper, which straps when unfolded and laid flat are the shape of a capital "T" with the depending portion of the T being the crotch strap and the top bar of the T being a waist encircling strap. The terminal ends, three in number, of the straps meet at the front or back of the infant when placed upon the infant to be secured to each other, preferably by Velcro to provide for adjustment for accommodation of different size infants during the rapid growth period of birth to one year and to provide for different size diapers and clothing beneath the holding device.

A further advantage is obtained by providing outer perimeter strap, which surrounds the pads and the waist encircling strap, to further assure that the pads will not be twisted or moved out of position to an extent that would permit the infant to roll to their front or back. Depending upon the structure of the pads and holding device, this outer peripheral strap may not be necessary and particularly it may not be necessary in the early months after birth when an infant is not as active as they are when they are approaching the age of one year old.

The outer strap provides for increased safety and stabilization. Preferably, the pads, at their apex portion, have loops through which the outer peripheral strap pass for increasing the stability and safety of the assembled device. The loops prevent the outer strap from sliding in the direction head to toe relative to the adjacent pad.

Preferably, the pads have an outer envelope of flame retardant material, which is preferably also waterproof. This outer envelope has some opening (zipper or Velcro closure for example) to provide removal of an inner pad (preferably foam resilient material) so that the inner pad and/or outer envelope may be cleaned.

One size may be provided for all infants in the first year from birth, or because of the rapid growth, two or more sizes may be provided.

Most preferably, the width of the pad at its base, as measured in a direction of the belt line, is approximately $\frac{3}{4}$ the width of the baby as seen in plan view.

According to a second embodiment of the invention, it is desired that the infant be easily placed in the device for restraining its movement and removed therefrom. This satisfies an objective wherein the infant is conveniently removed from the device for diaper changing and feeding, for example, and then placed back into the device for unsupervised rest time and sleeping.

The second embodiment of the invention includes a support member that is essentially flat and elongated in dimension with a midportion folding point to permit compactness and easy storage of the device. The top surface of the support has a Velcro material to which two pads having an outer covering of a pile fabric are secured. An appropriate spacing between the pads permits the infant to be placed therebetween on its side. A strap attached to each of the pads is then wrapped around the infant to maintain it in a position on its side between the pads. Preferably, the strap is secured around and passed under the arms of the infant and provided at its ends with a separable fastener such as Velcro that permits convenient coupling and uncoupling of the strap.

The elongated support member of the device according to the second embodiment is substantially longer than the width of the two pads so that the pads can be spaced apart a distance appropriate to receive infants of varying sizes, from prematurely born infants to infants up to one year old. Preferably the pads are provided with a substantially wide flat bottom surface that engages the support member to anchor the pads for preventing movement while supporting the infant therebetween. Further, it is preferred that the pad facing the front of the infant is shorter than the pad facing the back of the infant so that no portion of the front facing pad interferes with the infant's face, which might otherwise present breathing problems or undesirable obstacles to expelling fluids from the infant's mouth, such as spit up. Alternatively, the pads can be of the same size with the front facing pad shifted with respect to the back facing pad so that the infant's face is not obstructed.

For convenience, the device of the second embodiment is easily stored by folding the elongated support member about the midportion thereof, which functions as a hinge between two sides of the support member. Since the pads are releasably secured to the support member, for example by Velcro, the support member, pads and strap can easily be stored in a pouch or tote bag so that the device is easily made portable.

For each of the embodiments, the pads provide a convenient surface for mounting toys, decorations, sleep monitors such as sound monitoring microphones, and the like.

In addition to its primary use, the device is particularly useful when traveling with a small infant, so that an infant may be placed upon any surface, such as a table, floor or bed and left to sleep without fear of the infant rolling to a dangerous amount, such as rolling sufficiently to fall off of a table or bed.

The use of only one pad still has advantages as opposed to the most desirable configuration of the device when two pads are provided. With Velcro fasteners, it is easy to attach only one of the pads and leave off the other pad.

BRIEF DESCRIPTION OF THE DRAWING

Further objects, features and advantages of the present invention will become more clear from the following detailed description of a preferred embodiment as shown in the drawing, wherein.

DETAILED DESCRIPTION OF A PREFERRED EMBODIMENT

Figure 1:
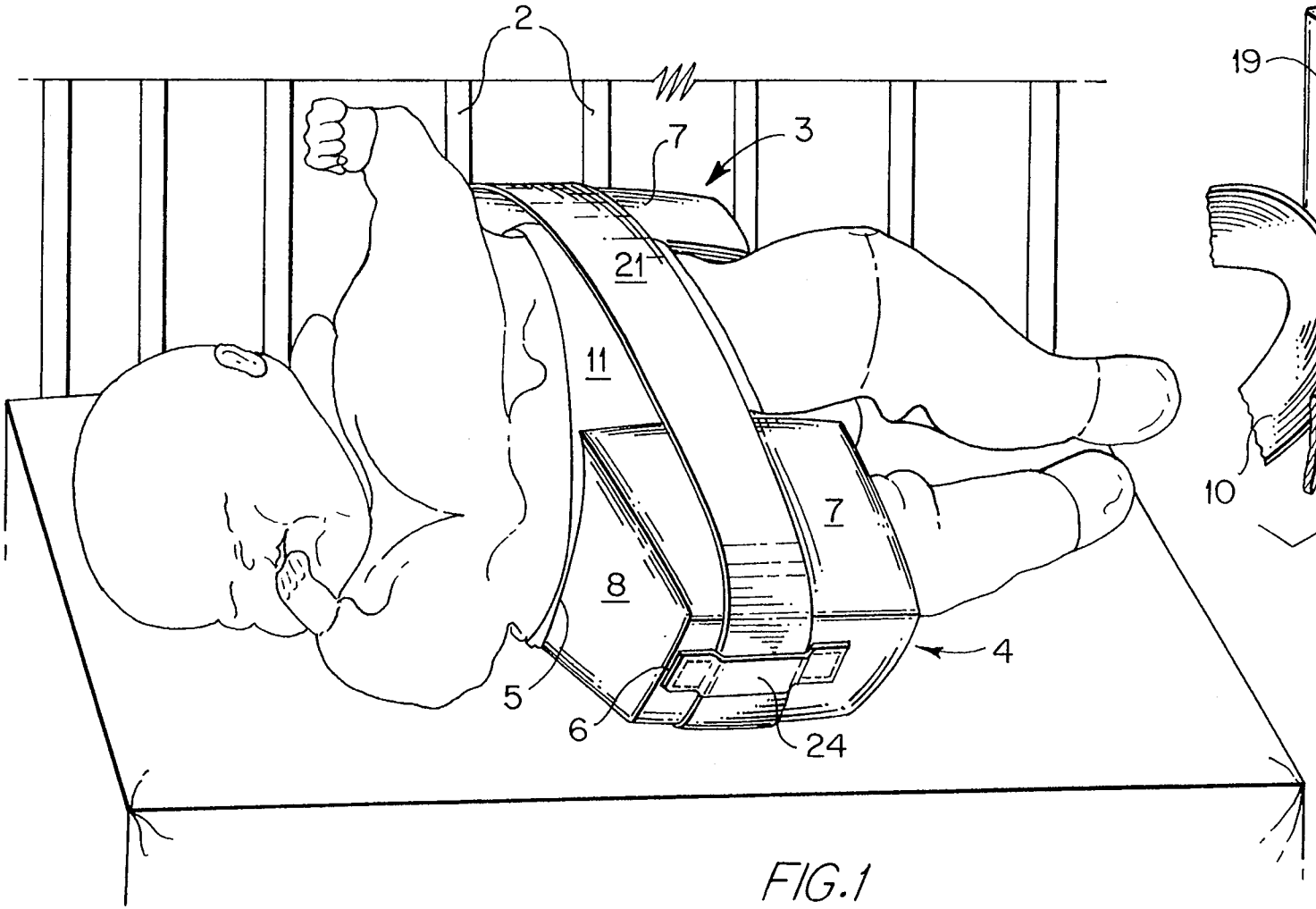
FIG. 1 is a perspective view of a first embodiment of the device as worn by an infant showing its orientation with respect to a crib.
Figure 2:
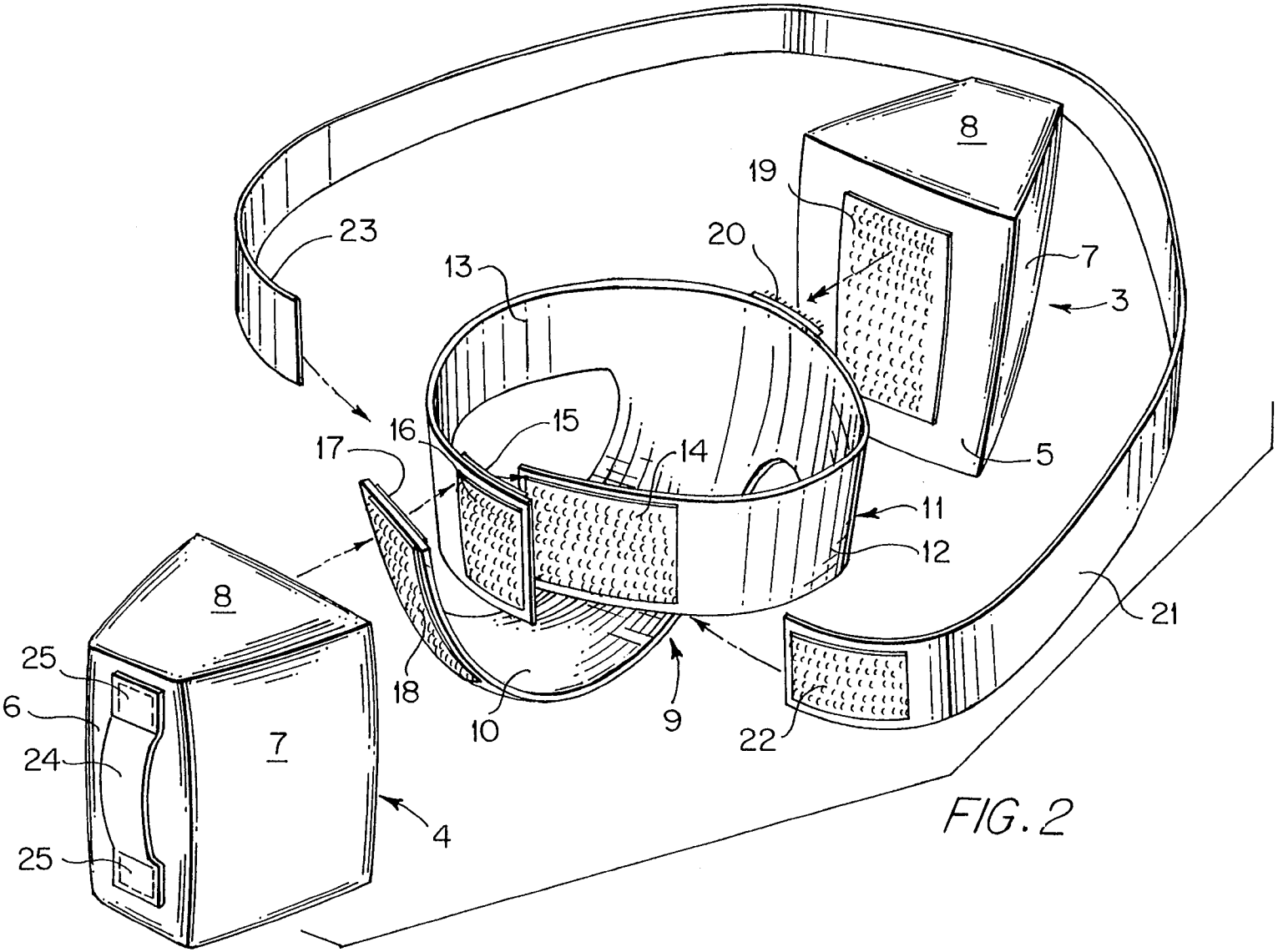
FIG. 2 is an exploded view of the device of FIG. 1 with the same orientration as FIG. 1.

In FIG. 1, there is shown a baby sleeping on his/her right side in a crib, and with the device of a first embodiment of the present invention assembled and attached to the infant. The crib generally comprises a planar horizontal support surface 1, more specifically a crib mattress, and a crib side 2, with it being understood that there may be additional crib sides. Of course, the present invention is useful without any crib sides or crib, for example when the baby is placed on a bed, table or floor that has only a planar horizontal support surface. Orientations of the device will be with reference to corresponding orientations of an infant wearing the device. For example, the front of the device is the portion adjacent the front or stomach of the baby, the back of the device or rear is that portion adjacent the back of the infant, the right and left sides of the device are respectively adjacent the right and left sides of the baby when worn, the top of the device is adjacent to or as seen from the top or head of the baby and the bottom of the device is adjacent to or as seen from the feet of the baby.

Figure 3:
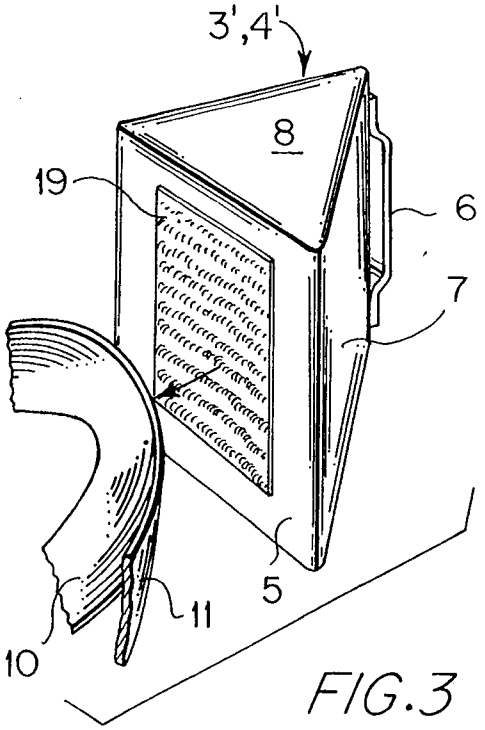
FIG. 3 is a detail of the pad attachment used in the embodiment of FIG. 1, but showing a modified construction for the pad.

The device of FIG. 1 comprises a rear pad 3 and a front pad 4. The rear pad may be identical to the front pad to provide for interchangability and ease of manufacture, although they may be different for various other reasons. FIGS. 1 and 3 show different shapes for the pads. Preferably, each of the pads has a base 5 that directly contacts the infant, with the inter-position of holding straps to be described, clothing and the like. This base 5 can be a flat planar surface or a concave surface conforming to the shape of the baby. Preferably, the apex portion, the portion furthermost from the baby, is of less extent than the base portion 5, so that the side 7 will converge in the direction moving away from the infant. This structure permits the infant some range of movement while the infant is sleeping on their side, to facilitate movement during sleeping and exercising when awake, without degrading the function of the pads to prevent the baby from moving to their stomach or back, respectively.

The device of the first embodiment further comprises a diaper-like holding device 9 that when laid flat (a flat orientation is not shown in the drawing) would resemble a capital "T" shape composed of a depending portion of the T or crotch strap 10 and a bar portion of the T 11 that basically has left and right side straps 12, 13 that extend at right angles to the crotch strap 10 so that they together 12, 13 form a waist encircling band. The terminal ends of the straps 10, 12, 13 meet at the center stomach area of the infant when assembled, or alternatively at the center back area of the infant when assembled. The terminal end of the left side strap 12 is provided with an outwardly facing Velcro strip 14, the terminal end of the right side strap 13 is provided with an inwardly facing Velcro strip 15 and an outwardly facing Velcro strip 16, and the terminal end of the crotch strap 10 is provided with an inwardly facing Velcro strip 17 and an outwardly facing Velcro strip 18. As seen, the terminal ends of these straps will overlap each other and be attached to each other by the contacting Velcro strips. For example, the strips 14 and 15 may be mating male and female strips, the strips 16 and 17 may be mating male and female strips.

The base portion of each of the pads is provided with an inwardly facing Velcro strip 19, which will be complimentary to and mating with the Velcro strip 18 on the outside of the crotch strap 10. On the outside of the holding device 11, at the junction of the straps 10, 12, 13, there is an outwardly facing Velcro strip 20 that is complimentary to the Velcro strip 19 on the pads 3, 4. Thereby, the pad 3 may have its Velcro strip 19 mating with the Velcro strip 20 and the pad 4 may have its Velcro strip 19 mating with the Velcro strip 18.

In addition to the holding device 11 and the pads 3, 4, an outer peripheral securement strap 21 is provided that encircles the pads 3, 4, the holding device 9 and the infant, as shown for example in FIG. 1. This strap increases the stability and security of the assembled device, although it may not be necessary on all occasions. Strap 21 has an outer Velcro strip 22 at one terminal end and an inwardly facing Velcro strip 23 at its other terminal end. The Velcro strips 22 and 23 are complimentary, that is respectively male and female, to join the terminal ends of the securement strap 21. The terminal ends of the securement strap 21 may overlap at any peripheral position, for example front, back, sides or any position therebetween. As seen, the securement strap 21 encircles the device in the belt direction, that is roughly concentric to the straps 12, 13. To further ensure the security of the assembled device, each of the pads 3, 4 is provided with a loop 24 secured at it's ends by stitching 25. The securement strap 21 passes through the loops 24 and the loops 24 prevent the securement strap 21 from sliding in either an upward or lower direction, respectively towards the top or bottom, off of the apex of the pads.

Figure 4:
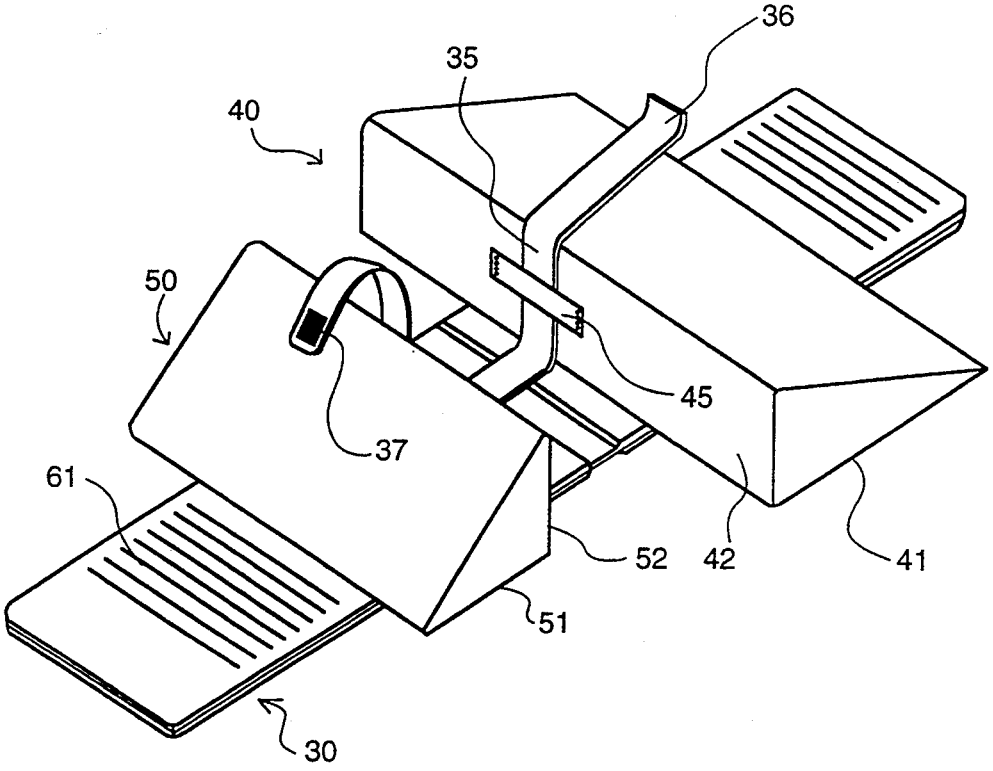
FIG. 4, is a perspective view of a second embodiment of the device.
Figure 5:
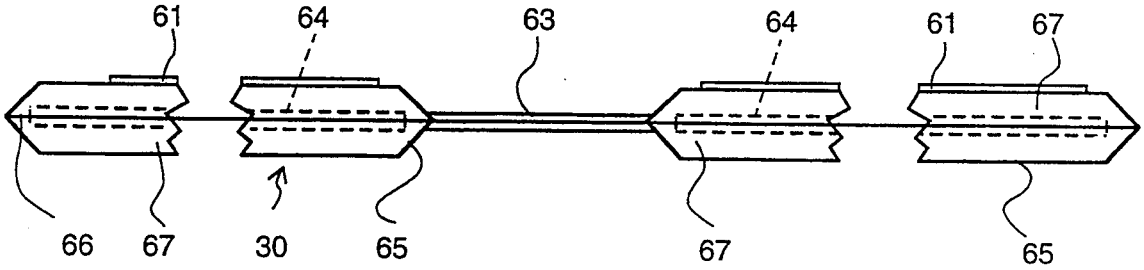
FIG. 5 is a side view showing a preferred construction of the support member of the device of FIG. 4.

FIGS. 4 and 5 show the device of the second embodiment of the invention. A support member 30 has a top surface 61 with a hook fabric, which is intended to be part of a hook and pile fabric fastener, such as Velcro. A rear pad 40 and front pad 50 are provided along their respective bottom surfaces 41, 51 with a pile fabric that secures the pile fabric bottom of the pads to the support member 30. The infant is placed between the pads on its side with its back supported by rear pad 40 and its front supported by front pad 50. Then, a strap 35 having releasable fastening ends 36, 37 is wrapped around to restrain the infant in place between the pads.

The bottom surfaces 41, 51 of the pads are sufficiently wide to permit secure attachment of the pads to the support member. Since the attachment is made by Velcro, for example, the pads can be spaced an appropriate distance apart for the size of the infant being restrained. As shown in FIG. 4, each of the pads has sides 42, 52 extending upwardly from the support member 30 at substantially right angles thereto to engage the infant's back and front or stomach, respectively, to restrain the infant in a position lying on its side with its face extending toward front pad 50. In this regard, front pad 50 is shown to be shorter in length than rear pad 40 so that no portion of front pad 50 engages or obstructs the infant's face. On the other hand, read pad 40 has a portion 40*a* that is intended to support the back of the infant's head.

Strap 35 is preferably about 3 inches wide and is positioned to pass underneath the infant's arms. This ensures that the strap will not work its way up to the infant's neck causing possible strangulation. The strap is secured to pads 40, 50 through loops 45, only one of which is shown, stitched at their ends to sides 42, 52 of the pads. Of course, the straps could be secured to the pads in a more permanent manner, such as by stitching, or alternatively by releasable securing devices, such as snaps or buttons. It is preferred that the strap be attached by the loops since this permits relative movement between the strap and pads for adjusting the spacing between the pads it is also preferred that the strap be easily removable from the pads to permit cleaning of the device. The connection of the strap to the pads helps to maintain the pads in relative position with respect to one another and with respect to the infant. This connection in combination with the secure attachment of the pads to the support member 30 keeps the front pad from moving into a position that may obstruct the infant's face.

The support member 30, as shown in FIG. 5, is substantially longer than the combined width of the two pads to permit adjustment in spacing between the pads for different size infants. To permit portability and easy storage of the device, the support member is preferably hinged at its midportion 63. Support member 30 is constructed with a relatively stiff inner board member 64 encased by a waterproof jacket or covering 65 of material such as plastic sealed along its edges 66 by thermal bonding for example. At the midportion 63 of the support member, no inner stiffening member is present so a hinge joint is formed of the covering material. Further, padding 67 or other fabric material and the like can be provided to sandwich the inner stiffening member, as shown in FIG. 5.

In an alternative construction of the support member 30 to that shown in FIG. 5, the inner stiffening member is not formed of a rigid material, but rather from a semi-rigid material such as a heavy fabric material or leather-like material that provides support for the attached pads to prevent their relative movement while retaining flexibility. Maintaining flexibility in the support member can be advantageous when the device is used on a relatively soft under support surface, such as a mattress or sofa, so that the support member conforms to the support surface and comfortably supports the infant, as well.

While preferred embodiments of the device have been set forth along with modifications and variations to show specific advantageous details of the present invention, further embodiments, modifications and variations are contemplated within the broader aspects of the present invention, all as set forth by the spirit and scope of the following claims.

We claim:

1. An infant position restraint device comprising:

an elongated support member having a top surface with one of a two-part separable fastening material covering at least a portion of the support;

a rear pad and front pad, each having a bottom surface covered with the other of the two-part releasable fastening material for securing the pads on the support member in an orientation that permits an infant to be positioned on its side between the pads, and each of said pads having a substantially perpendicular side wall extending upwardly from the support member, the side walls engaging the front and the back of the infant for supporting the infant in a rest position while lying on its side, wherein the front pad is oriented with respect to the rear pad so that the generally perpendicular side wall of the front pad supporting the front of the infant does not obstruct the infant's face, whereas the corresponding generally perpendicular side of the rear pad supports the back of the infant including its head; and a strap releasably secured to each of the pads for restraining an infant on its side between the pads and having a two-part releasable fastening material at the respective ends of the strap for coupling the ends of the straps together, and wherein the strap is positioned with respect to the front and rear pads so that the strap passes under the infant's arm, and further wherein said strap is releasably secured to each of the pads along the respective generally perpendicular side walls thereof so that the strap passes around he infant without encircling the pads to secure the infant to the pads.

2. An infant position restraint according to claim 1, wherein the support member is substantially longer than a combined width of the pads as measured across the bottom surfaces of the pads that engage the support member.

3. The infant position restraint device according to claim 1, wherein the support member has an outer waterproof jacket and an inner stiffening member, and wherein the support member has a hinged joint at its midportion thereof permitting folding of the support member for storage of the restraint device.

* * * * *